US007648053B2

(12) United States Patent
Rose et al.

(10) Patent No.: US 7,648,053 B2
(45) Date of Patent: Jan. 19, 2010

(54) LINEAR SLIDING GATE VALVE FOR A METALLURGICAL VESSEL

(75) Inventors: William Rose, Dunkirk (FR); Dominique Verrelle, Fentange (FR); Albert Gauche, Fentange (FR)

(73) Assignee: Tech-Gate S.A., Luxembourg (LU)

( * ) Notice: Subject to any disclaimer, the term of this patent is extended or adjusted under 35 U.S.C. 154(b) by 208 days.

(21) Appl. No.: 11/908,265

(22) PCT Filed: Jan. 12, 2006

(86) PCT No.: PCT/EP2006/050171

§ 371 (c)(1),
(2), (4) Date: Dec. 6, 2007

(87) PCT Pub. No.: WO2006/094846

PCT Pub. Date: Sep. 14, 2006

(65) Prior Publication Data

US 2008/0157020 A1 Jul. 3, 2008

(30) Foreign Application Priority Data

Mar. 10, 2005 (EP) ..... 05101886

(51) Int. Cl.
*B22D 41/22* (2006.01)

(52) U.S. Cl. ..... 222/594; 222/600; 251/230

(58) Field of Classification Search ..... 251/230, 251/326; 222/591, 594, 597, 598, 604
See application file for complete search history.

(56) References Cited

U.S. PATENT DOCUMENTS 3,430,644 A * 3/1969 Lyman ..... 251/230
3,764,042 A 10/1973 Shapland et al.
3,850,351 A * 11/1974 Yoshihara ..... 222/598
4,013,090 A * 3/1977 Taylor ..... 251/230
4,202,473 A * 5/1980 Szadkowski et al. ..... 222/598
4,220,270 A 9/1980 Szadkowski
4,498,611 A * 2/1985 Yoshihara ..... 222/594

(Continued)

FOREIGN PATENT DOCUMENTS

BE 1008119 1/1996

(Continued)

OTHER PUBLICATIONS

International Search Report; PCT/EP2006/050171; Mar. 6, 2006.

*Primary Examiner*—John Bastianelli
(74) *Attorney, Agent, or Firm*—Cantor Colburn LLP

(57) ABSTRACT

A linear sliding gate valve (10) for a metallurgical vessel comprises a slide plate (20) with a first orifice (30) and a fixed plate (22) with a second orifice (32). A slideable tray (26) supports the slide plate (20) and is arranged to slide the slide plate (20) relative to the fixed plate (22) so as to control an outflow of the metallurgical vessel by the relative position of the first and second orifices (30; 32). The slide plate (20) is rotatable relative to said slideable tray (26). The sliding gate valve further comprises a ratchet mechanism (40; 140) for providing defined angular positions of the slide plate (20). The ratchet mechanism (40; 140) is mounted on the slideable tray (26) such that the slideable tray (26) forms the fixed frame of the ratchet mechanism (40; 140).

29 Claims, 10 Drawing Sheets

U.S. PATENT DOCUMENTS

| | | | | | |
|---|---|---|---|---|---|
| 4,591,080 | A | * | 5/1986 | Yoshihara | 222/598 |
| 4,732,304 | A | * | 3/1988 | Yoshihara | 222/598 |
| 4,747,580 | A | * | 5/1988 | Tinnes et al. | 222/598 |
| 4,998,650 | A | * | 3/1991 | Yamazaki | 222/599 |

FOREIGN PATENT DOCUMENTS

| | | |
|---|---|---|
| EP | 0 346 258 | 11/1989 |
| FR | 2713525 | 6/1995 |
| JP | 05 200533 | 11/1993 |

* cited by examiner

LINEAR SLIDING GATE VALVE FOR A METALLURGICAL VESSEL

TECHNICAL FIELD OF THE INVENTION

The present invention relates to a linear sliding gate valve for a metallurgical vessel.

BRIEF DISCUSSION OF RELATED ART

Sliding gate valves are used in metallurgy to open or shut a pouring orifice of a metallurgical vessel such as a teeming ladle, a tundish, a converter or an electric arc furnace. Sliding gate valves allow to control the rate of flow of molten metal by variation of the flow passage aperture. A typical application is continuous casting of steel, where molten steel is transferred at a desired rate from a tundish into a continuous casting mould.

Generally, two different types of linear sliding gate valves can be distinguished. In so called three plate sliding gate valves, a slide plate is longitudinally movable, i.e. slideable in between an upper and a lower fixed plate the latter two being stationary with respect to the vessel. Each plate has an orifice and those of the stationary plates are coaxial. The position of the orifice in the slide plate relative to the coaxial orifices determines the flow passage aperture and thus the flow rate. The flow rate is controlled by means of a linear sliding operation displacing the slide plate. In the second type of sliding gate valves, the lower stationary plate is omitted, the working principle of the sliding gate valve however remains the same. The present invention particularly applies to sliding gate valves of the latter type.

A critical element in such linear sliding gate valves is the slide plate which generally comprises a flat piece made of an appropriate refractory material. Due to considerable thermal, mechanical and chemical stresses exerted on the slide plate, cracking of the refractory material occurs after only several casting operations. With operating temperatures at the orifice above 1500° C. and the related thermal expansion, cracking occurs for example due to tensile stress inside the refractory material caused by differing temperature gradients or due to compressive stress caused by the fixation of the slide plate. Other causes may be chemical attacks of the flowing material and mechanical wear due to the considerable contact pressure. It is also known that wear is most pronounced in the area of the slide plate which slides underneath the orifice of the fixed plate. To this area of localised wear adds the tendency of the orifice of the slide plate to grow in the sliding direction, i.e. to become oval. The latter two factors also have a part in cracking of the refractory which has two major detrimental consequences. On the one hand, there is the need to replace the slide plate and, on the other hand, there is the reduction of the flow channel imperviousness with the resulting risks of hot metal leakage and gas inclusion in the flow. In continuous casting of steel for example, the refractory plates normally need to be replaced after at most five casting cycles of the sliding gate valve.

Accordingly, there is a desire to increase the durability i.e. the working life of the refractory plates in general, and the slide plate in particular. By reducing the replacement frequency, significant cost savings related to maintenance operations and spare parts can be achieved.

Since the sliding gate valve is a device relevant to plant safety, there is also a desire to have more control over the degradation of the refractory plates and increased knowledge on the condition of the sliding gate valve in general and the refractory plates in particular.

In order to overcome part of the above problems, U.S. Pat. No. 3,764,042 proposes a slideable gate mechanism, i.e. a sliding gate valve, in which a closure element for a vessel outlet is a disk which is mounted for rotational movement in a linearly reciprocally slideable tray. Each time the outlet is closed, the disk is rotated to prolong the working life of the disk. The mechanism disclosed in U.S. Pat. No. 3,764,042 is of relatively simple construction but allows to rotate the disc only in combination with a sliding operation. Since the possible angle of rotation is limited, several sliding operations are required to obtain a certain angular position which results in additional wear of the refractory plates. Another drawback related to the mechanism of U.S. Pat. No. 3,764,042 are the safety risks related to carrying out rotation during operation. For example a failure of the rotation capacity can result in the impossibility to close the vessel outlet. EP 0 346 258 proposes a slide plate which is rotationally symmetrical and has a central orifice. The slide plate is rotatable in the sliding gate valve during operation. The sliding gate valve disclosed in EP 0 346 258 comprises a combined mechanism which allows both sliding the slide plate linearly and, independently thereof, rotating the slide plate about its axis of symmetry. This combined mechanism is however relatively complex and requires an additional actuator at the casting site for performing the sliding operation. Moreover, with the device as disclosed, a relatively complex control mechanism is necessary for controlling both actuators. In consequence, a considerable susceptibility to failure can be expected in the severe environment imposed in metallurgical plants. In addition, rotation of the slide plate during operation of the sliding gate valve, requires additional intervention and knowledge of the casting operator.

These may be reasons why the disclosed devices have not found widespread use in industry today. Nevertheless, the findings disclosed in the prior art, i.e. the rotational symmetry of the slide plate in order to reduce thermo-mechanical stresses and the rotation of the slide plate in order to delocalise wear, should be acknowledged as contributions to increased durability of the slide plate.

BRIEF SUMMARY OF THE INVENTION

The invention provides an improved sliding gate valve which at least partially overcomes the above problems.

The present invention proposes a linear sliding gate valve for a metallurgical vessel which comprises a slide plate with a first orifice and a fixed plate with a second orifice and a linearly slideable tray supporting the slide plate and arranged to slide the slide plate relative to the fixed plate so as to control an outflow of the metallurgical vessel by the relative position of the first and second orifices. The slide plate is rotatable relative to said slideable tray. The sliding gate valve further comprises a ratchet mechanism for providing defined angular positions of the slide plate. According to an important aspect of the invention, the ratchet mechanism is mounted on the slideable tray such that the slideable tray forms the fixed frame of the ratchet mechanism.

The ratchet mechanism allows to rotate the slide plate about an axis essentially perpendicular to its surface so as to distribute or delocalise wear. The ratchet mechanism is mounted on the slideable tray so as to provide defined angular positions of the slide plate independently of the (sliding) position of the slideable tray. The ratchet mechanism allows rotating the slide plate independently of the sliding operation without the necessity of having additional actuating means for performing the sliding operation. There is thus no need for a second actuator to be coupled to the sliding gate valve to enable the latter to perform flow control. In fact, it has been found that there is no benefit in performing rotation during sliding operation e.g. at the casting site. On the contrary, in the presence of a metal deposit, there is some risk of disengaging the refractory plates by rotation, i.e. creating a gap there between. In operation this would cause a significant danger of molten metal leakage and gas inclusion. Due to the normally existing contact pressure between the fixed plate and the slide plate, the defined angular positions that can be set by means of the ratchet mechanism are automatically maintained, independently of the presence of actuating means. In addition, since the ratchet mechanism is independent of the slide mechanism, although unlikely, a possible failure of the ratchet mechanism does not inhibit normal operation of the sliding gate valve. The sliding gate valve operates in conventional manner at the casting site and rotation is preferably carried out separately and independently e.g. at a service site or in a maintenance shop. In fact, the sliding gate valve is normally transferred together with the metallurgical vessel to a service site after each casting operation e.g. for emptying residual content of the metallurgical vessel. In consequence, no additional transfer operation is required.

The sliding gate valve preferably comprises a rotatable slide plate support mounted on said slideable tray. The rotatable slide plate support forms the retaining seat for the slide plate and allows to avoid friction at the inactive side of the slide plate during rotation.

In a preferred embodiment, the ratchet mechanism comprises a ratchet wheel, which is fixed to the rotatable slide plate support, a pusher, which is mounted movable relative to the ratchet wheel on said slideable tray, and a pawl, which is pivotably mounted to the pusher. These parts are arranged so as to transform linear action of the pusher into rotation of the slide plate.

During operation, the sliding gate valve comprises a flow control actuator for positioning the slideable tray, i.e. carrying out the sliding operations. In order to actuate the pusher, the ratchet mechanism preferably comprises a coupling fixed to the slideable tray for coupling a distinct removable linear actuator to the ratchet mechanism. The coupling is adapted to receive a suitable linear actuator such as a hydraulic cylinder. After rotation of the slide plate, the linear actuator can be easily removed by virtue of the coupling. A similar coupling is advantageously provided for the flow control actuator.

Normally, a tightening contact pressure is provided between the slide plate and the fixed plate during operation of the sliding gate valve. In an advantageous variant of the invention, the sliding gate valve further comprises a pressure reduction device for controlled reduction of the contact pressure. Since sliding gate valves are normally constructed with a housing and a hinge to swing open the housing, this feature is advantageously used to the aforementioned effect. Accordingly, a simple pressure reduction device comprises a catch for limiting the opening of the housing to a predetermined span, whereby contact pressure is reduced in controlled manner.

In order to avoid accidental rotation of the slide plate, e.g. due to torques exerted by the slide mechanism, the ratchet mechanism preferably comprises a blocking mechanism for blocking unintentional rotation of the rotatable slide plate support. In addition to the one sense of rotation which is blocked by nature of the ratchet mechanism, this blocking mechanism blocks rotation also in the allowed sense of rotation. This blocking mechanism is designed so as to be ineffective when intentional rotation by means of a linear actuator is carried out.

It has been found advantageous to use slide plates which comprise a rotationally symmetrical, preferably disc-shaped, refractory. In addition, the first orifice is beneficially made rotationally symmetrical, preferably circular, and provided centrically in the refractory. By providing equal or similar path lengths to the thermal waves propagating from the orifice to the periphery of the refractory, tensile stresses are reduced.

According to a further variant of the invention, the sliding gate valve preferably comprises a clamping ring for fastening the slide plate. This clamping ring is blocked in rotation on the rotatable slide plate support and comprises a plurality of resilient fastening members for resiliently fastening the slide plate to the clamping ring. By virtue of resilient fastening, a predetermined extent of thermal expansion in the radial direction is permitted whereby adverse mechanical stresses in the refractory of the slide plate are reduced.

It has been found beneficial to dispose the resilient fastening members in rotational symmetry, i.e. at regular angular intervals, on the inside of the clamping ring. Their number is preferably greater than 4.

Advantageously, adjustable pre-tension means are associated to the resilient fastening members for applying a predetermined prestress to the resilient fastening members. Thermal dilatation being unavoidable, this measure allows to determine the lower limit above which dilatation of the slide plate is permitted and thus some control of thermo-mechanical stresses so as to remain below the limits of rupture resistance.

The clamping ring preferably comprises at least three rigid links with corresponding articulations. The articulated links allow uniform circumferential distribution of the fastening force exerted onto the slide plate by the resilient fastening means. In combination with a suitable closure, they allow a simple slide plate exchange operation by widening the opened clamping ring.

The slide plate normally comprises an outer steel band, e.g. made of steel, which rims the refractory by means of a shrinkage fit. Advantageously, the steel band and the clamping ring each comprise cooperating blocking means for blocking the slide plate in rotation with respect to the clamping ring. In addition to the resilient fastening members, such blocking means permanently insure a determined orientation of the slide plate relative to the clamping ring and, in consequence, relative to the rotatable slide plate support.

It has been found beneficial to design the slide plate such that the ratio of the outer diameter of the refractory to the diameter of the first orifice is greater than or equal to 4.

It has furthermore been found beneficial to produce the slide plate and the fixed plate such that they have identical dimensions. As a result they can be easily interchanged.

According to another aspect of the invention, a method for operating a linear sliding gate valve as described hereinbefore comprises the step of coupling a linear actuator to the ratchet mechanism and rotating the slide plate by means of the ratchet mechanism. This step is preferably carried out when the sliding gate valve is not in operation, e.g. at a service site or in a maintenance shop so as to avoid safety risks. Accordingly, no modification to the conventional casting procedure and no additional knowledge of the casting operator is required.

In a variant, the method further comprises the step of reducing the operative contact pressure between the slide plate and the fixed plate in controlled manner by means of a pressure reduction device prior to rotating the slide plate. Thereby, rotation is eased and abrasion of the slide plate and the fixed plate during rotation is reduced.

In a further variant, the method further comprises the step of measuring one or more operational parameters of the linear actuator during rotation of the slide plate. In an additional variant, the method further comprises the step of measuring one or more operational parameters of a flow control actuator coupled to the slideable tray during operation of the sliding gate valve. In case of hydraulic cylinders used as actuators, the above parameters are for example the effective piston displacement, the pressure in both chambers of the hydraulic cylinder, the duration and/or variation in time of these pressures or any suitable combination thereof. These parameters are beneficially used e.g. to check correct operation of the ratchet mechanism and/or the sliding gate valve. Furthermore, these parameters contribute to preventive maintenance.

Although the ratchet mechanism can theoretically be used during operation of the sliding gate valve, its is preferred to carry out the steps of coupling a linear actuator to said ratchet mechanism and rotating said slide plate by means of said ratchet mechanism at a remote site and when said sliding gate valve is not operative.

BRIEF DESCRIPTION OF THE FIGURES

The present invention will be more apparent from the following description of several not limiting embodiments with reference to the attached drawings, wherein.

DETAILED DESCRIPTION OF THE INVENTION

Figure 1:
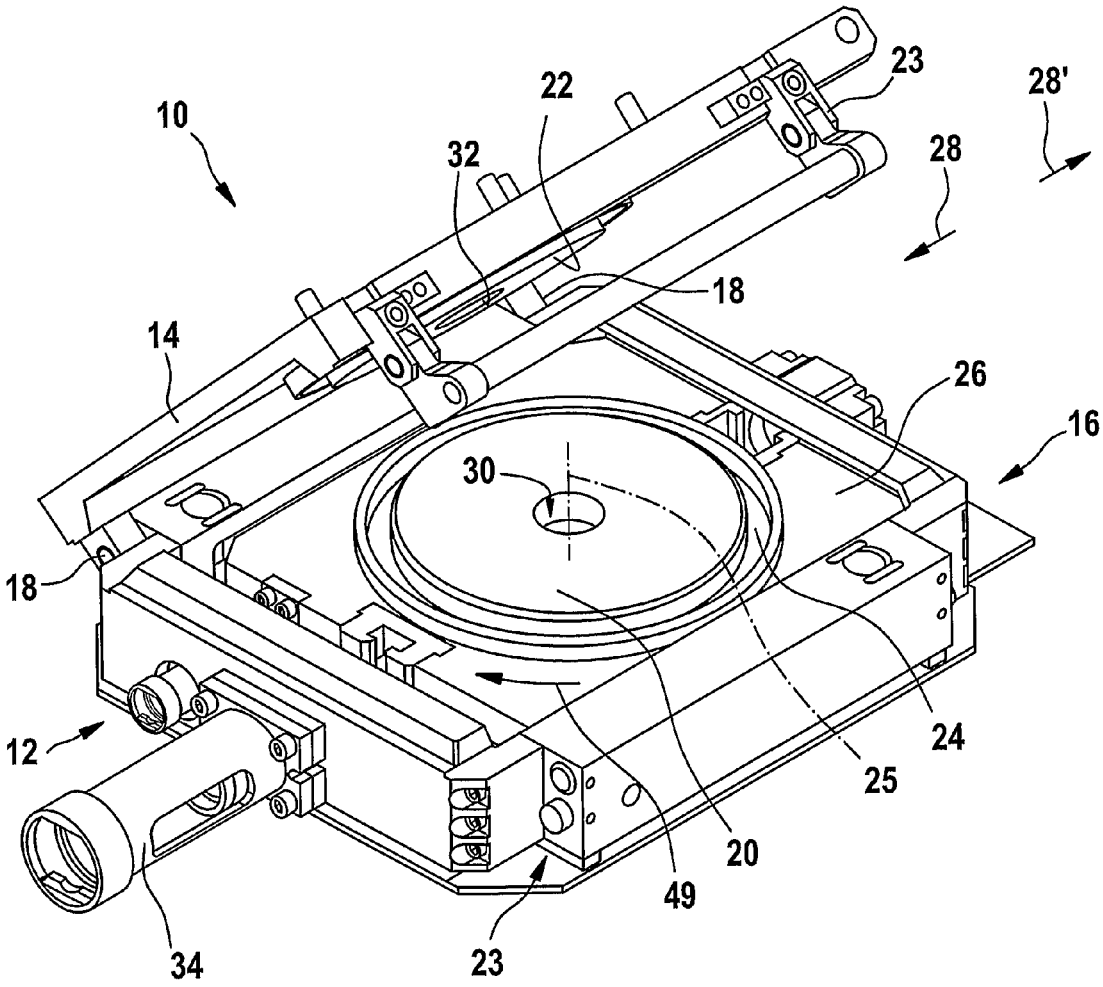
FIG. 1: is a perspective view of a first embodiment of a sliding gate valve in open condition inter alia showing a slide plate.

FIG. 1 shows a first embodiment of a linear sliding gate valve generally identified by reference numeral 10. The sliding gate valve 10 comprises a housing 12 with a cover 14 and a frame 16. The cover 14 is pivotably mounted to the frame 16 by means of a hinge 18 such that the housing 12 can be swung open as seen in FIG. 1, e.g. for inspection and maintenance. Depending on the requirements, the hinge 18 can be provided on the short side instead of the long side of the housing 12. Opening the housing 12 gives access to a slide plate 20 and a fixed plate 22. The housing 12 can be opened and closed by means of a lock device 23 arranged on the side opposite to the hinge 18. The lock device 23 comprises suitable locking means on the cover 14, corresponding cooperating means on the frame 16, and a manually operable lever bar for actuating the locking means 23. The slide plate 20 is mounted on a rotatable slide plate support 24 so as to be blocked in rotation with respect to the latter. The slide plate support 24 is mounted on a slideable tray 26 so as to be blocked in translation but rotatable about an axis 25.

During operation, the sliding gate valve 10 is closed and fixed to a metallurgical vessel (not shown) via the cover 14. In a manner known per se, a linear translation of the slideable tray 26 according to arrow 28 or 28' allows to change the coincidence of a first orifice 30 in the slide plate 20 and a second orifice 32 in the fixed plate 22. The variation of the coincidence of the first and second orifices 30, 32 or the absence of coincidence thereof respectively allow controlling an outflow out of the metallurgical vessel or stopping this outflow. During operation, the slideable tray 26 is translated by means of a flow control actuator (not shown), e.g. a linear hydraulic cylinder, which is coupled to the housing 12 via a first coupling 34.

Figure 2:
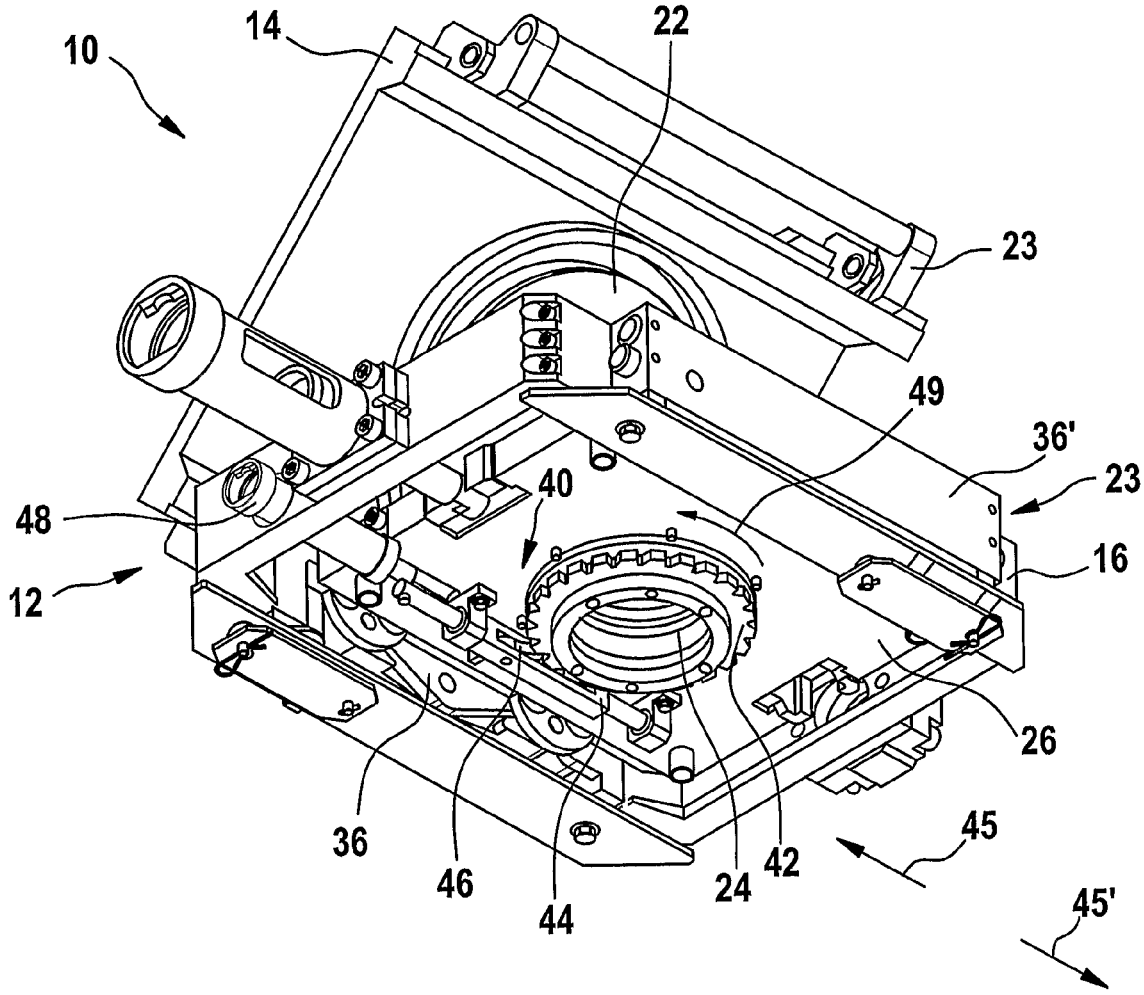
FIG. 2: is a different perspective view of the sliding gate valve of FIG. 1 showing a ratchet mechanism for rotating the slide plate.

FIG. 2 shows the sliding gate valve 10 of FIG. 1 from a different perspective. Pressurizing devices 36 and 36' are provided on the long sides of the frame 16. The pressurizing devices 36, 36' provide a tightening contact pressure between the slide plate 20 and the fixed plate 22 when the housing 12 is closed e.g. during operation of the sliding gate valve 10. In a manner known per se, the pressurizing devices 36, 36' are designed to provide a uniform contact pressure over the surfaces of the slide plate 20 and the fixed plate 22. This contact pressure is essentially independent of a possible angle between these surfaces and of the translational position of the slideable tray 26.

FIG. 2 also shows a ratchet mechanism 40. The ratchet mechanism 40 is coupled to the rotatable slide plate support 24 and mounted to the slideable tray 26 on the side opposite to the slide plate 20. In fact, the slideable tray 26 forms the rigid frame or rigid link of the cinematic chain defining the ratchet mechanism 40. Accordingly, the ratchet mechanism 40 is arranged displaceable with the slideable tray 26. The ratchet mechanism 40 comprises a ratchet wheel 42, which is fixed to the rotatable slide plate support 24 and a pusher 44, which is movable relative to the ratchet wheel 42 according to arrows 45 and 45'. A pawl 46 is pivotably arranged on the pusher 44. The ratchet mechanism 40 acts as gear transforming linear action of the pusher 44 into rotation of the slide plate 20. A second coupling 48 is fixed to the slideable tray 26 and allows to couple a linear actuator (not shown) such as a hydraulic cylinder to the ratchet mechanism 40 and more precisely to the pusher 44. The second coupling 48 moves with the slideable tray 26 and protrudes through a corresponding hole in the frame 16. Accordingly, the second coupling 48 also acts as an external visual indicator of the position of the slideable tray 26. It thus helps avoiding accidental destruction of the slide plate 26 by oxygen opening, a commonly occurring mistake in case of a clogged flow passage in the metallurgical vessel.

The ratchet mechanism 40 transmits a defined rotary motion in discrete steps to the slide plate 20 and warrants a defined angular position of the slide plate 20. By nature of the ratchet mechanism 40, rotation of the slide plate 20 is restricted to one sense only as indicated by arrow 49. Undesired rotation in the allowed sense 49 is also avoided. In fact, the housing 12 is normally opened only for replacement of the slide plate 20 and/or fixed plate 22 whereby a given contact pressure between the slide plate 20 and the fixed plate 22 is warranted. This is mainly because, by tradition, once the sliding gate valve 10 has been opened the plates 20, 22 are replaced irrespective of their condition. Moreover, rotation of the slide plate 20 is normally carried out at a predetermined contact pressure. This contact pressure during rotation can be identical to the tightening contact pressure during operation or, depending on the requirements, to a reduced contact pressure. In a different approach, the bearing of the rotatable slide plate 24 can be designed with friction for the same effect. Due the above (operational or reduced) contact pressure, any unintentional rotation of the slide plate 20 in the allowed sense 49 is avoided and a given angular position of the slide plate 20 is maintained after it has been set.

It is thus not necessary to have the linear actuator mounted to the sliding gate valve 10 during operation and more specifically it is not necessary for the linear actuator to be present at the casting site. In fact, rotation is preferably carried out when the sliding gate valve 10 is not in operation, e.g. at a service site. In addition, by virtue of the ratchet mechanism 40, no sophisticated control device is required to insure defined angular positions of the slide plate 20.

Since rotation of the slide plate 20 by means of the ratchet mechanism 40 is operatively independent of the sliding function of the slideable tray 26, safety of use is improved compared to prior art rotating devices. Even in an unlikely case of malfunction e.g. of the ratchet mechanism 40 or the bearing of the rotatable slide plate support 24, the sliding gate valve 10 is still operational in conventional manner since rotating and sliding of the slide plate 20 are not mechanically coupled.

If it is desired to ease rotation and to reduce abrasion of the slide plate 20 and the fixed plate 22, the sliding gate valve 10 is provided with a pressure reduction device for controlled reduction of the operative contact pressure as mentioned above and shown in FIGS. 9-14. With respect to FIGS. 1 and 2, similar or identical parts are identified by the same reference numerals in FIGS. 9-14.

Figure 9:
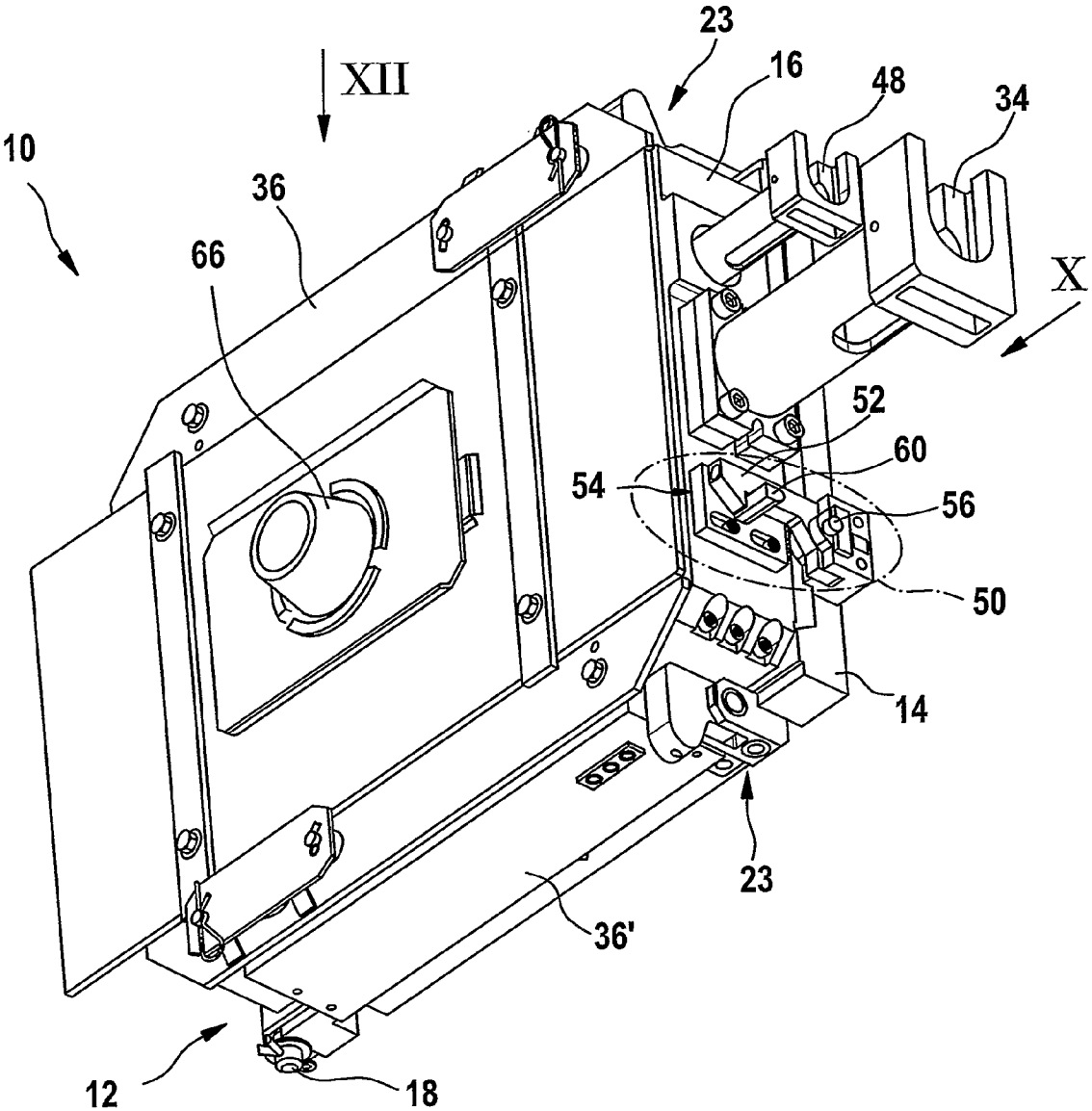
FIG. 9: is a perspective view of a fourth embodiment of a sliding gate valve showing a pressure reduction device.
Figure 10:
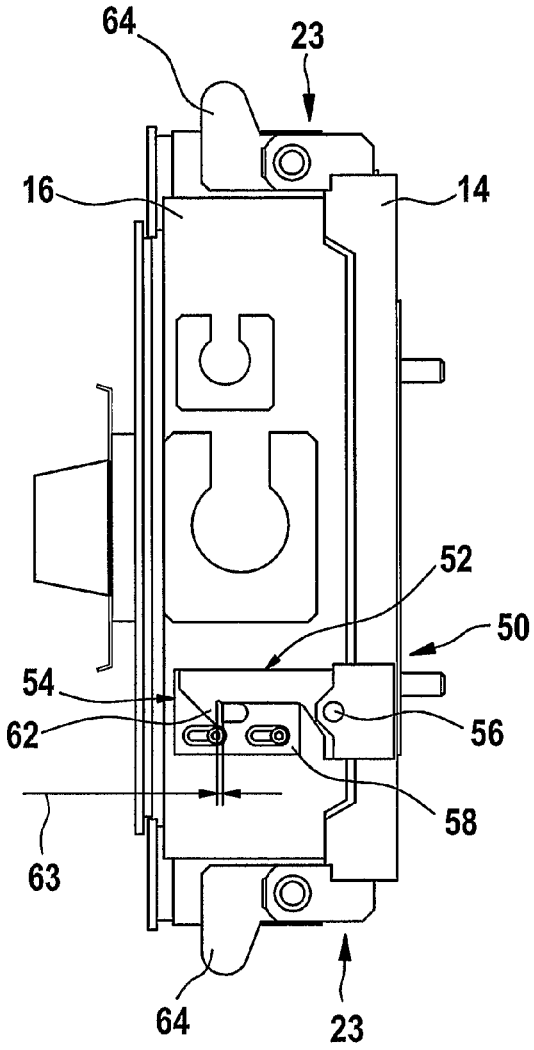
FIG. 10: is a lateral side view of the sliding gate valve of FIG. 9 in fully compressed condition.
Figure 11:
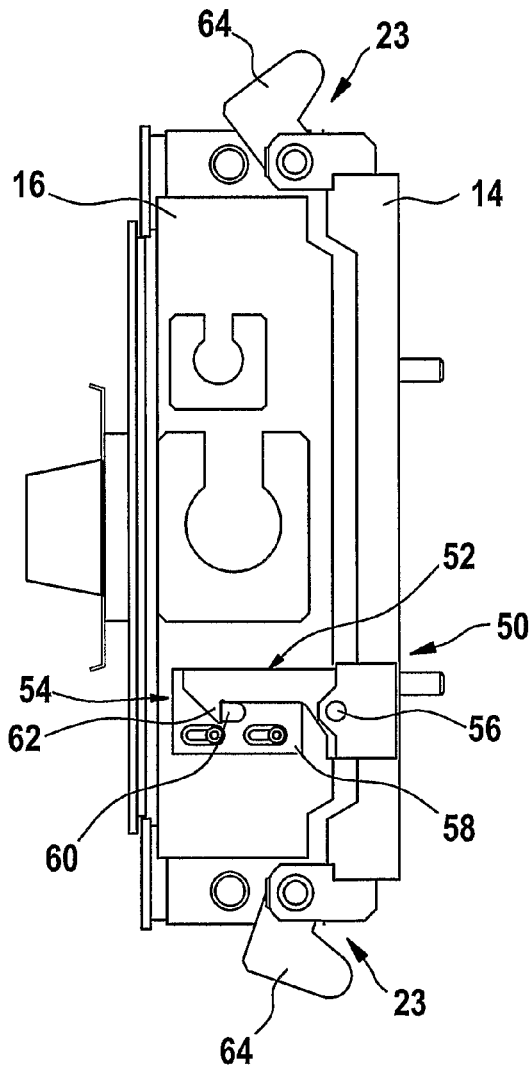
FIG. 11: is a lateral side view of the sliding gate valve of FIG. 9 in partially decompressed condition.
Figure 12:
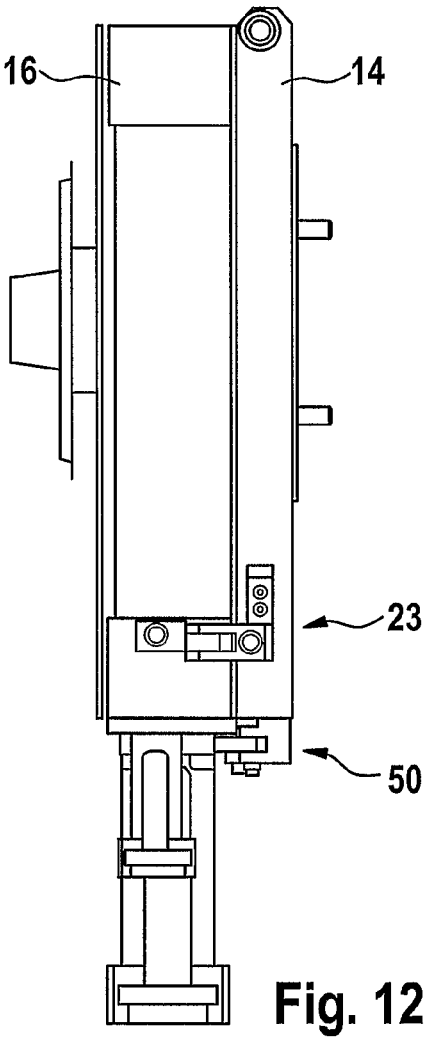
FIG. 12: is a longitudinal side view according to FIG. 10.

In a simple embodiment, a pressure reduction device 50 as shown in FIG. 9 comprises a catch and stopper contrivance to limit the opening swing of the housing 12. FIG. 9 shows the pressure reduction device 50 which comprises a catch 52 and a stopper 54. The catch 52 is pivotably mounted to the cover 14 by means of a shaft 56. The stopper 54 comprises a base plate 58 mounted to the frame 16 and a protrusion 60 fixed to the base plate 58. As seen in FIGS. 10 and 11, which are side views according to arrow X in FIG. 9, the catch 52 has a tooth 62 which is arranged to engage the protrusion 60 of the stopper 56. The catch 52 is forced against the protrusion 60 by suitable resilient means or, if suitably arranged, simply by gravitation. When the housing 12 is closed, as seen in FIGS. 10 and 12, the operative contact pressure is given between the slide plate 20 and the fixed plate 22. In order to reduce or alleviate this contact pressure in controlled manner, the pressure reduction device 50, together with the lock device 23 and the hinge 18, allows a relatively small predetermined displacement indicated at 63 in FIG. 10.

Figure 13:
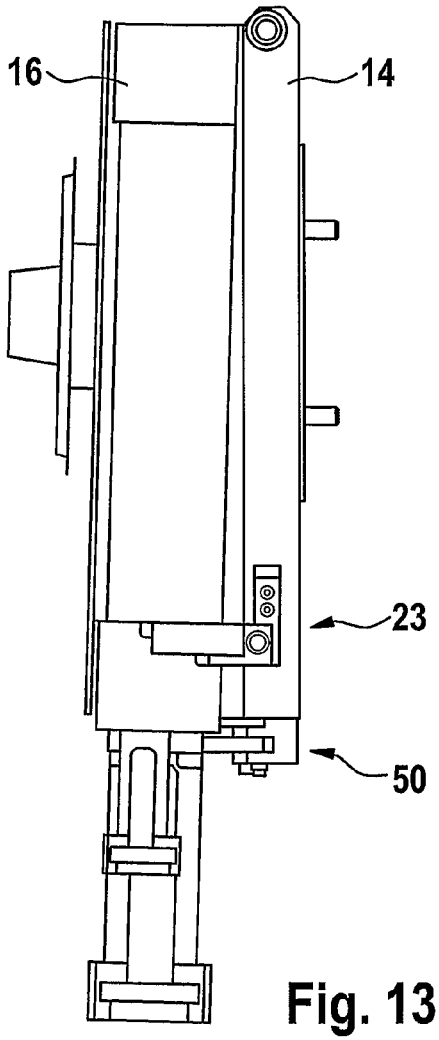
FIG. 13: is a longitudinal side view according to FIG. 11.

As seen in FIG. 11, when the housing 12 is unlocked by means of levers 64 of the lock device 23, the protrusion 60 is caught by the tooth 62 so as to limit the opening swing of the housing 12 to a small predetermined span, i.e. the displacement 63. FIGS. 12 to 13 are side views according to arrow XII in FIG. 9. When compared to the closed housing 12, i.e. the fully compressed condition shown in FIG. 12, there is an inclination between the cover 14 and the frame 16 in the partially decompressed condition of FIG. 13. It may be noted that, despite this inclination, the slide plate 20 and the fixed plate 22 are kept parallel and a uniform contact pressure is exerted over their surface by virtue of the pressurizing devices 36 and 36' as mentioned above.

It may be noted that the hinge 18 is arranged on the on the short side of the housing 12 in the sliding gate valve 10 of FIGS. 9-13. FIG. 9 also shows a collector nozzle 66 mounted to the rotatable slide plate support 24 (not shown in FIG. 9) in sealing contact downstream of the slide plate 20. The lock device 23 shown in FIG. 9 is adapted to lateral opening of the housing 12. Although not shown, the sliding gate valve 10 is normally mounted to the metallurgical vessel and located at a service site when controlled partial decompression by use of the pressure reduction device 50 is carried out. In this case, the sliding gate valve 10 is oriented vertically as shown in the FIGS. 9-14. The lock device 23 and the pressure reduction device 50 are arranged such that manipulations can be easily carried out in this configuration. Moreover, the second coupling 48 is arranged so as to be easily accessible.

Figure 14:
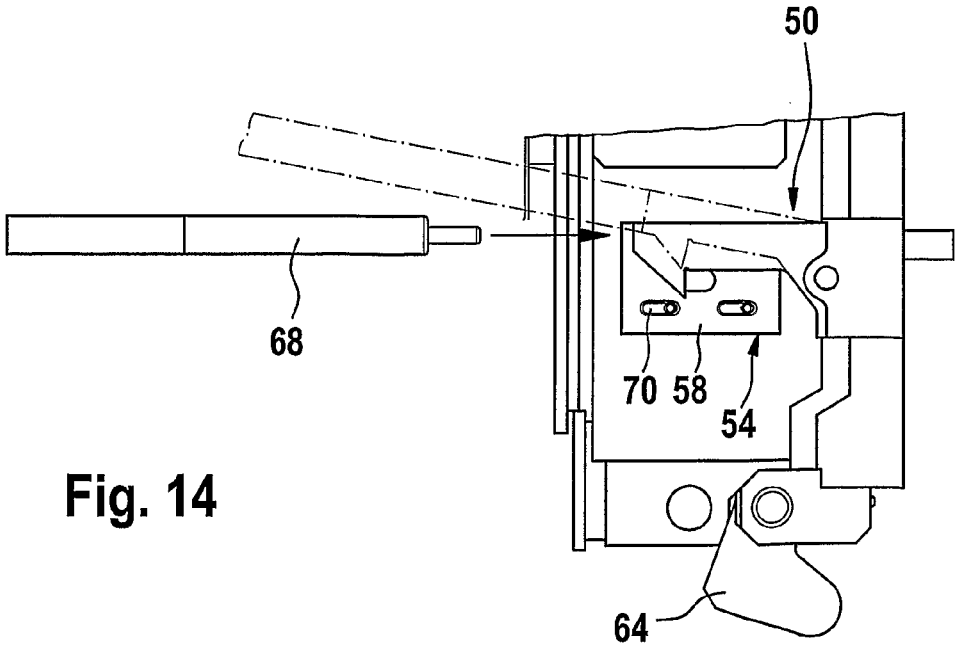
FIG. 14: is partial side view according to FIG. 11 showing a tool for opening the housing of the sliding gate valve.

As seen in FIG. 14, when it is desired to swing open the housing 12, a tool 68 is used to disengage the catch 52 and the stopper 54 into the position indicated by shaded lines. To this effect, the catch 52 has a bore corresponding to the tip of the tool 68. In fact, the same tool 68 is used in combination with the levers 64 of the lock device 23, which comprise similar bores. As further seen in FIG. 14, the base plate 58 of the stopper 54 comprises elongated slots 70, which allow precise adjusting of the allowed displacement 63 and consequently the amount of contact pressure reduction. It may be noted that the span is chosen such as to maintain a predetermined contact between the slide plate 20 and the fixed plate 22. By allowing a relatively small displacement, the pressure reduction device 50 insures controlled reduction of the operative contact pressure. It also prevents accidental opening of the housing 12.

Figure 3:
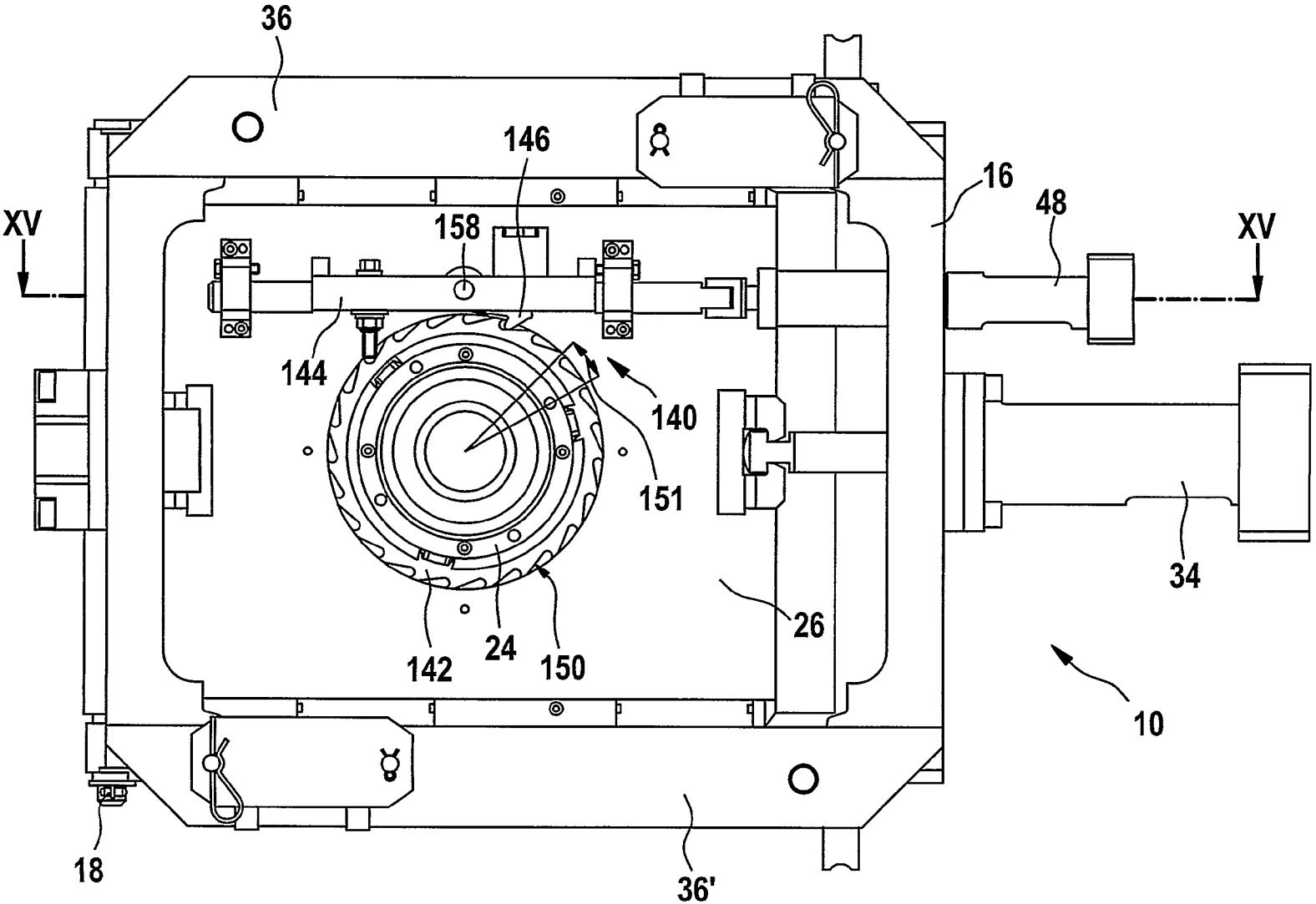
FIG. 3: is a top view of a second embodiment showing another ratchet mechanism.

FIG. 3 is a plan view of a sliding gate valve 10 with a ratchet mechanism 140 according to a second embodiment. With respect to FIGS. 1 and 2, similar or identical parts are identified by the same reference numerals in FIG. 3. The ratchet mechanism 140 is mounted to the slideable tray 26 and comprises a ratchet wheel 142, a pusher 144 and a pawl 146. The ratchet wheel 142 is provided with a plurality of indentations 150 which are inclined with respect to the radius of the ratchet wheel 142. As will be appreciated, the ratchet mechanism 140 is arranged to rotate the slide plate 20 in defined discrete steps 151, e.g. 15° in this embodiment, and warrants a defined angular position of the slide plate 20.

Figure 4:
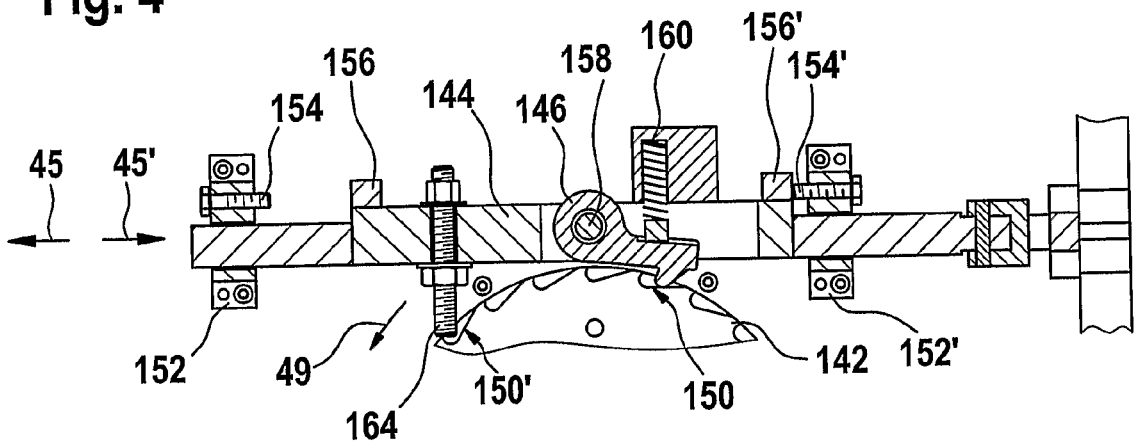
FIG. 4: is a partial sectional view of the ratchet mechanism of FIG. 3.

The ratchet mechanism 140 of FIG. 3 is shown in more detail in FIG. 4. Plain bearing mounts 152, 152' are fixed to the slideable tray 26 for guiding the pusher 144. Adjustable limit stops 154, 154' are provided on the plain bearing mounts 152, 152' to limit the stroke of the pusher 144 to a predetermined range in both directions indicated by arrows 45 and 45'. The limit stops 154, 154' cooperate with corresponding abutments 156, 156' fixed to the pusher 144. The pawl 146 is pivotable about a shaft 158 on the pusher 144. A first spring 160 warrants that the pawl 146 engages a given indentation 150 during rotation.

Figure 15:
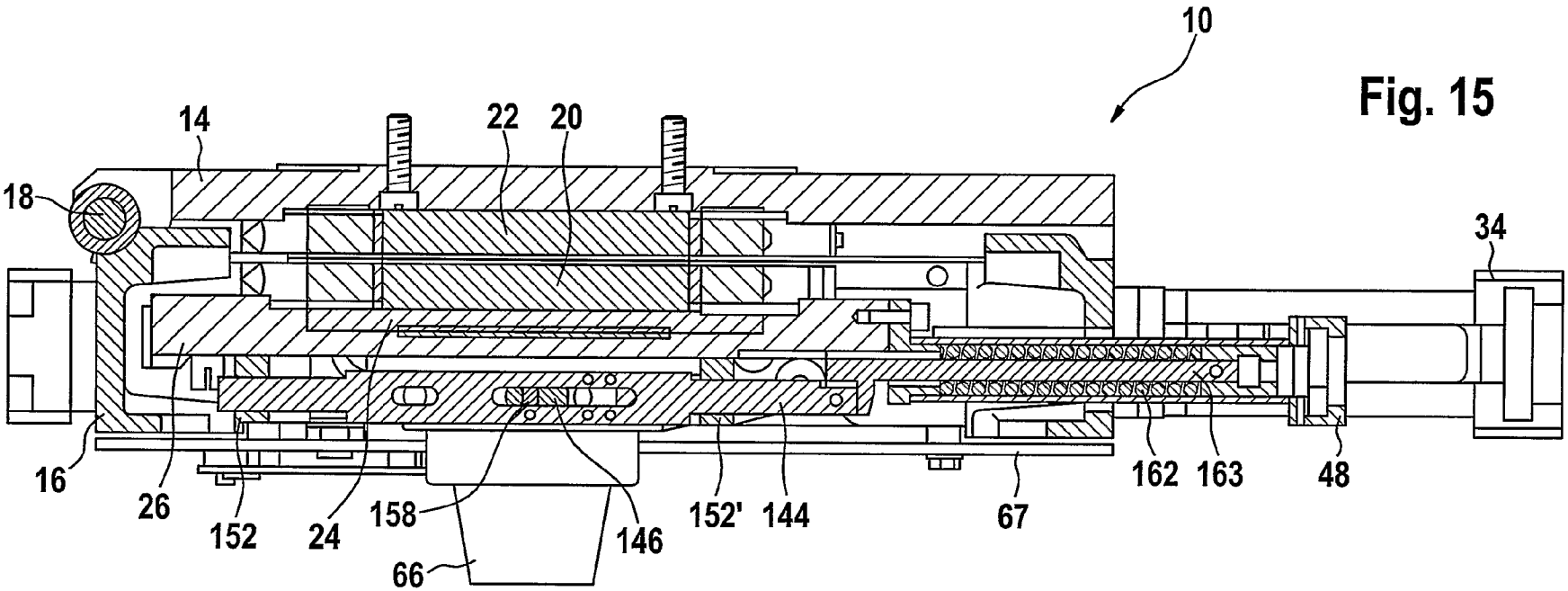
FIG. 15: is a longitudinal sectional view of the sliding gate valve of FIG. 3 taken along line XV-XV.

As best seen in FIG. 15, which illustrates a cross-section along line XV-XV of FIG. 3, a second spring 162 is provided inside the coupling 48. The second spring 162 is supported by the slideable tray 26 and acts on the pusher 144 via a connecting rod 163. Without action of a linear actuator coupled to coupling 48, the second spring 162 urges the pusher 144 into the position shown in FIGS. 3, 4 and 15. The second spring 162 is protected by the coupling 48 against detrimental influences. With respect to FIGS. 1 to 3, similar or identical parts are identified by the same reference numerals in FIG. 15. It may be noted that FIG. 15 further shows the collector nozzle 66 and a protective sheet metal lid 67 which is absent in the views of FIG. 1 to 3.

Turning back to FIG. 4, an adjustable blocking member 164 is fixed to the pusher 144 and protrudes perpendicularly towards the ratchet wheel 142. In the position as seen in FIGS. 3 and 4, the blocking member 164 engages a certain indentation 150' of the ratchet wheel 142. The blocking member 164 and the second spring 162 form a blocking mechanism for blocking rotation of the slide plate 20 in the allowed sense according to arrow 49. Additional blocking in the allowed sense 49 may be required if the aforementioned operative contact pressure does not sufficiently impede rotation in the allowed sense 49 or if significant torques can occur during operation. In the embodiment of FIGS. 3 and 4, the blocking member 164 also blocks rotation in the opposite sense, since the pawl 146 is not fully engaging the ratchet wheel 142. The second spring 162 is pre-tensioned and its spring constant is chosen such as to warrant a blocking engagement between the blocking member 164 and the ratchet wheel 142. By means of a sufficient force exerted by the linear actuator the second spring 162 can be compressed. Thus, by moving the pusher 144 according to arrow 45, the blocking member 164 is disengaged such that rotation in the allowed sense 49 is permitted.

Figure 5:
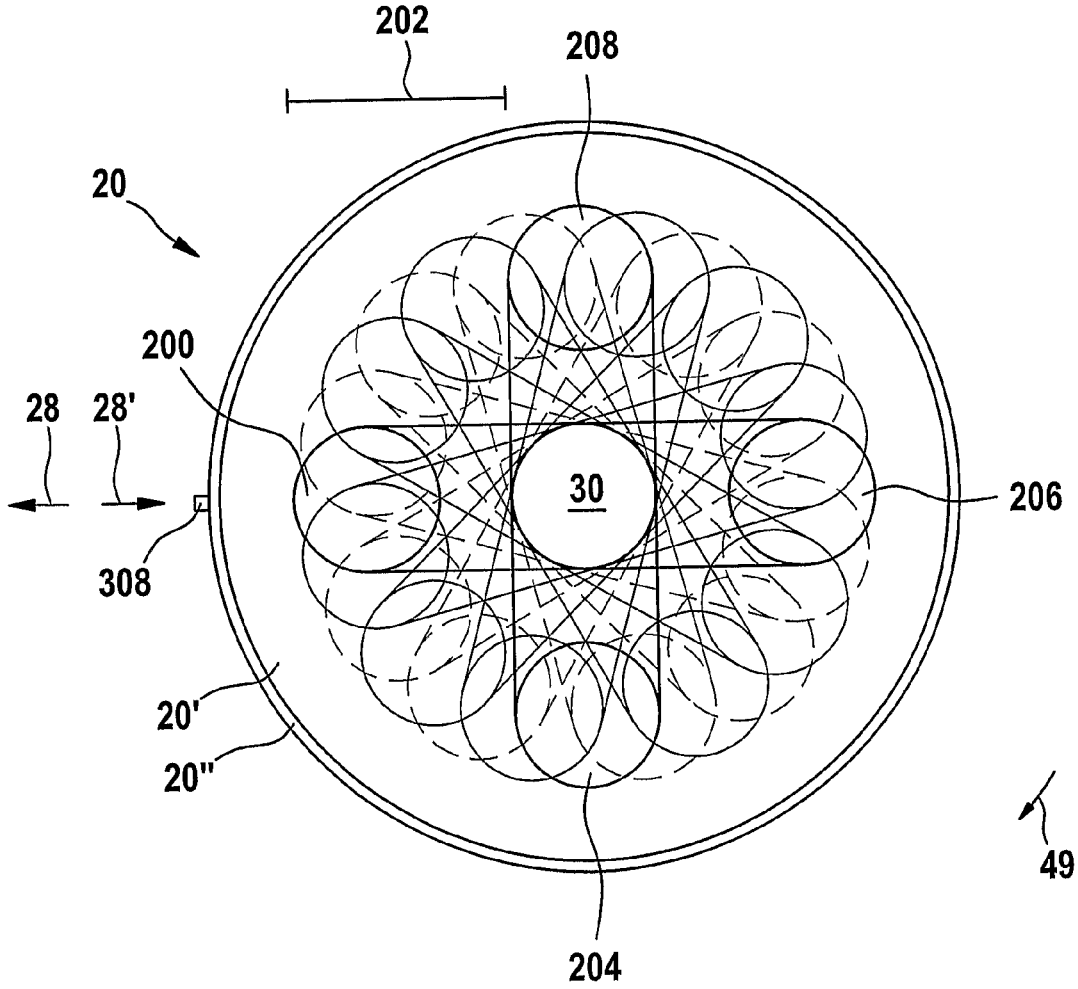
FIG. 5: is a top view of a slide plate showing a possible rotation pattern.

The slide plate 20 as best seen in FIG. 5 comprises a one piece circular disc 20' made of refractory material (e.g. alumina, zirconia, silica, magnesia, carbon or any suitable combination thereof) and having a axial circular central orifice, i.e. the first orifice 30. The disc 20' is provided with a circumferential steel band 20" made of a suitable steel. In a manner known per se, the steel band 20" is shrinkage fitted to the disc 20', to insure cohesion of the disc 20' even in case of cracking. In a specific embodiment the chosen parameters of the slide plate 20 are: outer diameter 450 mm; orifice diameter 90 mm; refractory thickness 40 mm; steel band thickness 5 mm and shrinkage fit at 1000° C. These values depend on the actual requirements however and can be chosen differently. Since the slide plate 20 is rotationally symmetrical, there is no preferred orientation and it can be readily rotated. More specifically, the refractory disc 20' is made so as to be isotropic to the most possible extent. The preferred mode of rotation and the function of the ratchet mechanism 40, 140 will be more apparent from the following description of FIG. 5.

With respect to FIG. 1, the slide plate 20 as shown in FIG. 5 is oriented according to arrows 28 and 28'. In FIG. 5, a first area of localised wear is identified by reference numeral 200 (indicated by shading). The area 200 forms the part of the slide plate 20 that is slid underneath the second orifice 32 and its length corresponds to the sliding range indicated at 202. During flow regulation the area 200 is at least partially located within the molten metal flow. Thus, during operation of the sliding gate valve 10, the area 200 is subjected to significant erosion and corrosion. By nature of the sliding gate valve 10, wear of the area 200 increases towards the first orifice 30, which results in the know symptom that the first orifice 30 grows in the direction of arrow 28. In order to delocalise wear over the useful surface of the refractory plate 20 and in order to avoid unsymmetrical growth of the first orifice 30, the ratchet mechanism 40, 140 allows to rotate the slide plate 20 according to arrow 49. In the embodiment as shown in FIG. 3, the ratchet wheel 142 is provided with 24 indentations such that a discrete rotational step of 15° results from each stroke of the pusher 144. Accordingly, a linear actuator coupled to the ratchet mechanism 40, 140 allows to place a previously unworn area 204, 206, 208 (indicated by shading) within the sliding range 202 and underneath the second orifice 32. As seen by the angular indications of the rotation pattern in FIG. 5, several consecutive strokes of the pusher 144 are carried out, e.g. 6 strokes in this example, to obtain a given degree of rotation, e.g. 90° in this example.

An exemplary method of operation of the sliding gate valve 10 equipped with the ratchet mechanism 40, 140 is summarized below:

during a casting operation:

- initiating, controlling and stopping an outflow out of a metallurgical vessel (not shown), in a manner known per se, by means of the sliding gate valve 10;

after the casting operation:

- transferring the metallurgical vessel with the sliding gate valve 10 to a service site (not shown) and turning the vessel, e.g. for emptying residual content, such that the sliding gate valve 10 is arranged vertically and accessible;
- coupling a linear actuator (not shown) to the second coupling 48, i.e. to the ratchet mechanism 40, 140;
- (optionally:) reducing the operative contact pressure by a predetermined amount using the locking device 23 and the pressure reduction device 50;
- (optionally:) aligning the first and second orifices 30, 32 by translating the slideable tray 26 into maximal flow position;
- controlling the linear actuator so as to produce a predetermined number of strokes which actuate the ratchet mechanism 40, 140 so as to rotate the slide plate 20 by discrete steps into a defined angular position;
- removing the linear actuator from the second coupling 48;
- (optionally:) executing other maintenance operations on the sliding gate valve.

While rotation of the slide plate is preferably carried out after every casting operation, it may be noted that the slide plate 20 and the fixed plate 22 are replaced only after a number of casting operations which depends on their condition. As will be appreciated, by delocalising wear of the slide plate 20, this number of casting operation exceeds the number that is possible with prior art sliding gate valves which have a non-rotatable slide plate.

An automated system (not shown) normally controls the linear actuator. In order to warrant that the predetermined number of strokes is effectively carried out, and more precisely that defined angular position is effectively reached, one or more operational parameters of the linear actuator, e.g. a hydraulic cylinder, are measured during rotation of the slide plate 20. These parameters include for example the effective piston displacement, the duration spent for a given displacement, the pressure in both chambers of the hydraulic cylinder and the duration and/or variation in time of these pressures. For instance, a pressure level above a defined permissible range indicates jamming or gripping of the plates 20, 22 or other mechanical components of the sliding gate valve 10. On the contrary, pressure levels below the permissible range indicate a rupture of the cinematic chain of the ratchet mechanism 40, 140. A factor which is preferably taken into account is the effective contact pressure during rotation, e.g. by knowledge of the settings of the pressurizing devices 36, 36' and, if applicable, of the pressure reduction device 50. This autocontrol of the ratchet mechanism 40, 140 and its linear actuator allows to detect a possible failure and thus contributes to insuring predetermined angular positions of the slide plate 20 throughout its working life.

In a similar approach, it is possible to measure one or more operational parameters of the flow control actuator during operation of the sliding gate valve 10. The aforementioned parameters, when measured on the flow control actuator during operation, give further information on the condition of the sliding gate valve 10 in general, and the plates 20, 22 in particular.

By means of the following steps or a partial combination thereof:

- a identifying the sliding gate valve (e.g. by bar code);
- tracking the evolution of the mechanical parts of the identified sliding gate valve (e.g. operating times of the parts, performed amount of sliding operations for opening/closing the sliding gate valve, etc.);
- tracking the evolution of its slide plate and its fixed plate (e.g. operating times of the plates, angular positions of the slide plate, etc.);
- a storing the operational parameters (e.g. piston displacement, displacement duration, piston pressures, pressure durations, etc.) of its linear actuator during rotation;
- storing the operational parameters (e.g. piston displacement, displacement duration, piston pressures, pressure durations, etc.) of its flow control actuator during operation;

it is possible to generate a database with history information on the sliding gate valve 10 in an information system. The history information is generated in the information system by taking into account mechanical parameters of the sliding gate valve 10 measured in the maintenance shop, at the service site and at the casting site. This history information is used as input for an operation control device of the sliding gate valve 10 and also for scheduling preventive maintenance. History information allows to optimise use and design of the sliding gate valve 10 in general, and in particular the rotation schedule in order to minimize wear of the slide plate 20. For example, such empirical data on the sliding gate valve 10 allows maximizing the operational time of its constituting parts, in particular the plates 20, 22, by avoiding premature replacement. Moreover history information increases safety of operation by scheduling necessary maintenance in due time.

Turing back to FIG. 5, several findings which resulted from the development of the present invention may be noted:

- a disc shape of the refractory with a central circular orifice is confirmed as being optimal with respect to thermal and mechanical stresses;
- the geometrical arrangement of the radial fixation of the slide plate on its support has an important influence on cracking;
- a diameter ratio of the outer diameter of the disc to the diameter of the orifice greater than or equal to 4, preferably 5, is preferred for reducing mechanical stresses and insuring acceptable temperatures at the border of the disc during operation;
- a conventional shrinkage fit steel band is sufficient to avoid concentrations of stresses caused by axial fixation of the slide plate on its support and to insure cohesion of the latter in case of cracking;
- an increased number of radial fixation points, i.e. greater than 4, has a beneficial effect on the durability of the slide plate, tensile stresses are significantly reduced;
- increasing the number of radial fixation points is limited by the ensuing reduction of dilatation freedom which results in increased compressive stresses;
- the thickness of the refractory has little influence on tensile stresses;
- known modes of rigid radial fixation of the slide plate do not allow to reduce tensile stresses in the refractory while insuring acceptable compressive stresses, in fact, a certain freedom of dilatation should be provided without jeopardizing flow control by free motion of the slide plate.

Figure 6:
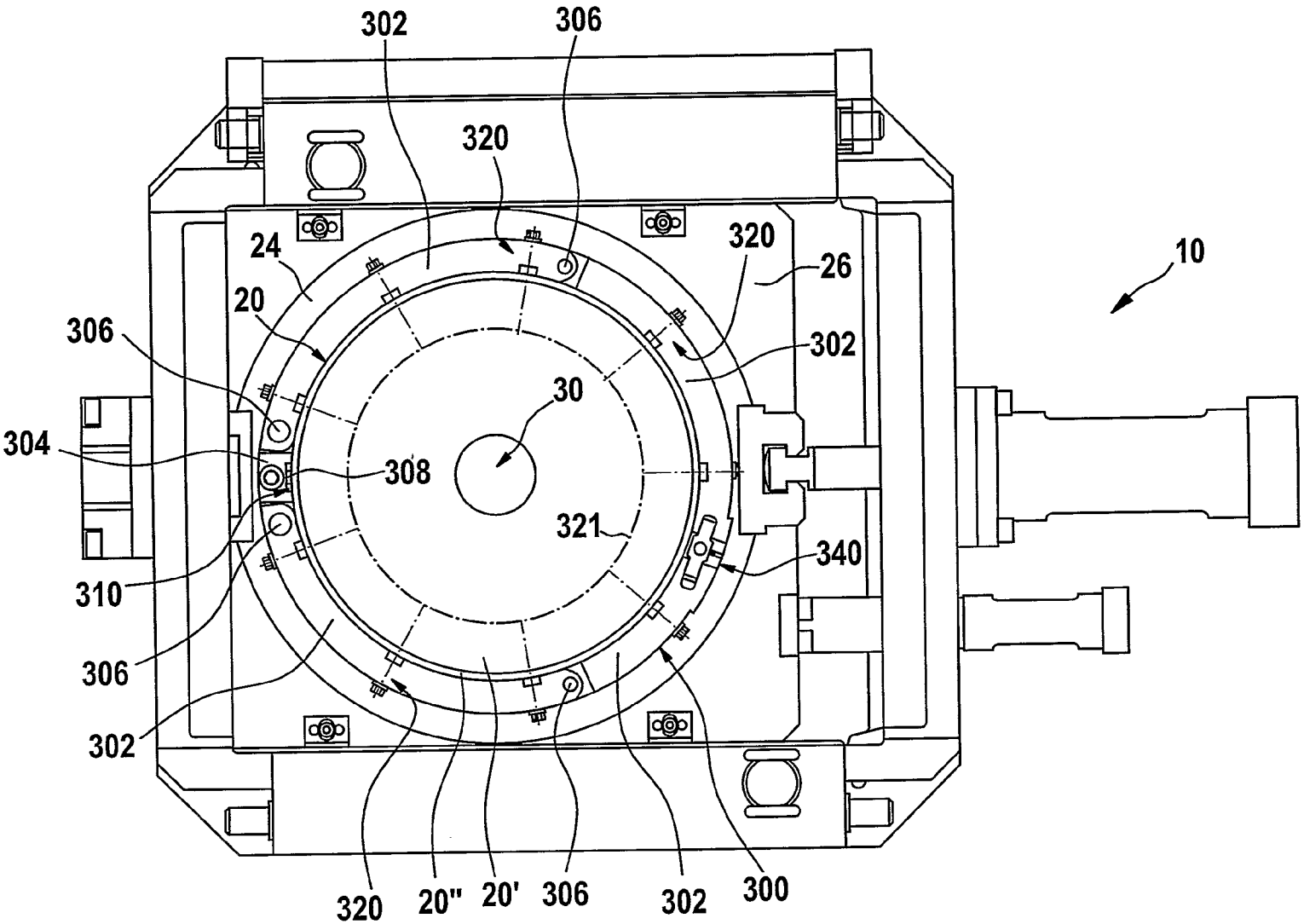
FIG. 6: is a top view of a third embodiment showing a slide plate support having a clamping ring.
Figure 7:
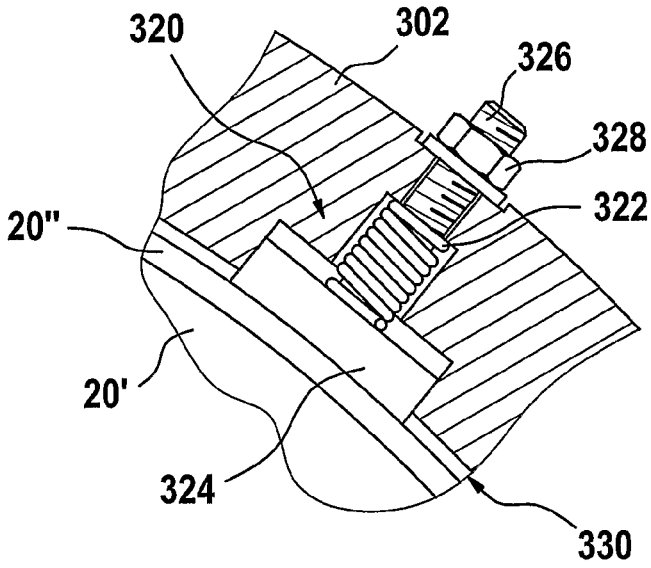
FIG. 7: is a partial cross sectional view of the clamping ring of FIG. 6.
Figure 8:
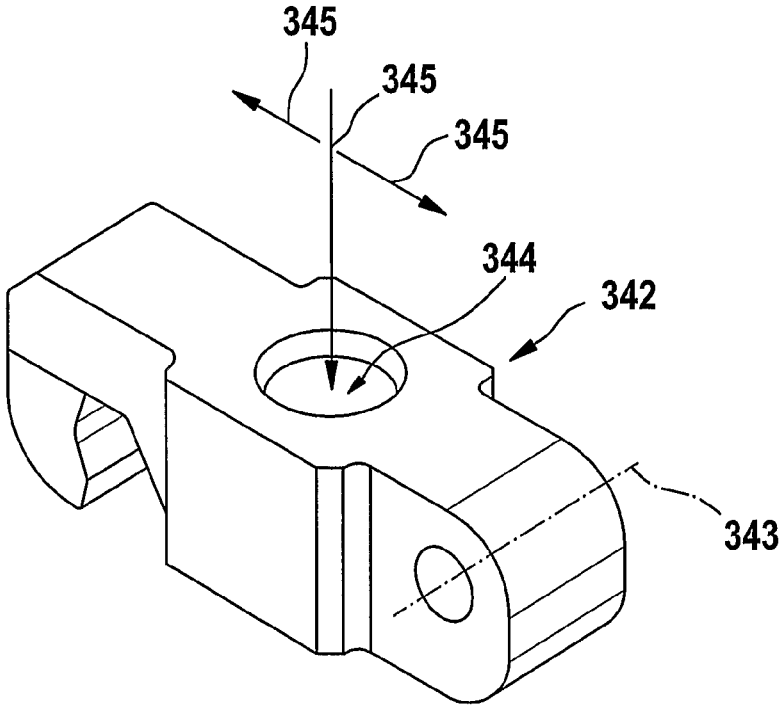
FIG. 8: is a perspective view of a lock of the clamping ring of FIG. 6.

FIGS. 6-8 show the details of a clamping ring 300 according to a third embodiment. With respect to FIGS. 1 and 2, similar or identical parts are identified by the same reference numerals in FIG. 6. The clamping ring 300 is designed in accordance with the above findings and independent of the ratchet mechanism 40, 140. The slide plate 20 in the sliding gate valve 10 of FIG. 6 corresponds to the slide plate 20 of FIG. 5. It comprises a disc shaped refractory 20' rimmed by a steel band 20" and has a central orifice, i.e. the first orifice 30. The clamping ring 300 allows to secure the slide plate 20 to the rotatable slide plate support 24 which is rotatable on the slideable tray 26. As seen in FIG. 6, the clamping ring 300 comprises 4 circular arc shaped rigid links 302 and a mounting block 304. The rigid links 302 and the mounting block 304 are interconnected by means of revolute joint type articulations 306 allowing relative rotation about axes perpendicular to the plane of FIG. 6. A small tenon 308 is fixed to the steel band 20" which fits into a mortise 310 in the mounting block 304. The tenon 308 (also shown in FIG. 5) cooperates with the mortise 310 so as to block the slide plate 20 in rotation with respect to the clamping ring 300 without blocking radial expansion of the slide plate 20 in the region of the tenon 308. In fact, the depth of mortise 310 is larger than the height of tenon 308. It may be noted that the tenon 308 allows to block the slide plate 20 in rotation without the necessity to modify the circular shape of the refractory disc 20'. The clamping ring 300 is blocked in rotation on the slide plate support 24 by means of the mounting block 304.

A plurality of resilient fastening members 320 are disposed in rotational symmetry on the circumference of the clamping ring 300. The fastening members 320 resiliently fasten the slide plate 20 relative to the clamping ring 300 in order to allow a certain amount of radial dilatation during operation. In the embodiment shown in FIG. 6, in total 9 resilient fastening members 320 are arranged in the clamping ring 300, i.e. they are disposed at regular angles of 40° as indicated at 321. As mentioned above, a sufficient number of radial fixation points allows to reduce tensile stresses in the slide plate 20. During operation, the resilient fastening members 320 also have a replacement function of the steel band 20" which, as has been found, tends to become plastically deformable to an unacceptable degree at the high operating temperatures of the sliding gate valve 10.

Each resilient fastening member 320, as best seen in FIG. 7, comprises a helical spring 322 supported by the respective rigid link 302 and pressing against a fastening element 324. Although helical springs 322 are described other suitable means such as disc springs or pneumatic mounts are not excluded. A threaded shaft 326 is fixed to the fastening element 324 and protrudes through a corresponding bore in the clamping ring 300. A nut 328 allows to pre-tension the helical spring 322 so as to maintain a rigid fixation of the slide plate up to a certain degree of dilatation. Any dilatation in excess of what corresponds to the predetermined prestress of the helical spring 322 is allowed up to the width of the radial clearance indicated at 330. The clamping ring 300 in combination with the fastening members 320 as shown in FIG. 7 insures a sufficient fixation of the slide plate 20 while allowing a certain amount of radial dilatation.

The clamping ring 300 is provided with an all-or-nothing type closure 340 in the region radially opposed to the mounting block 304. The clamping ring 300 and the closure 340 are designed so as to simplify the exchange of slide plate 20 and to preclude deregulation of the pre-tensioned fastening thereof. It comprises a lock 342 which is best seen in FIG. 8. The lock 342 is pivotably mounted to an end of one of the rigid links 302 by an axis 343 and engages a corresponding cavity in the end of the opposite link 302. The lock 342 has a bore 344 perpendicular to its pivot axis 343 which allows to use the tool 68 according to arrows 345 for opening and closing the clamping ring 300. The closure 340, in combination with the articulations 306 allows to widen the clamping ring 300 for exchange of the slide plate 20. It will be appreciated that the articulations 306, in combination with the resilient fastening members 320, insure auto-centering of the slide plate 20 with respect to the clamping ring 300 and accordingly the slideable tray 26. Although not shown, obviously a similar clamping ring is advantageously used for the fixed plate 22 in the sliding gate valve 10.

Turning back to FIGS. 1 and 2 it may be noted that the slide plate 20 and the fixed plate 22 have an identical configuration, i.e. identical dimensions. More specifically, besides rotational symmetry, both plates 20, 22 are symmetrical with respect to a central diametrical plane of symmetry. A used slide plate 20 may thus be utilized as fixed plate 22 and vice versa, so as to present its previously inactive surface as fresh active surface. If required, previous machining of the respective plate 20, 22 can be carried out. It will be appreciated that prolonged working life and reduced wear obtained with the presently disclosed sliding gate valve 10 contribute to the reuse capacity of the plates 20, 22.

The invention claimed is:

1. A linear sliding gate valve for a metallurgical vessel, comprising:

a slide plate having a first orifice;

a fixed plate having a second orifice;

a slideable tray supporting said slide plate and arranged to slide said slide plate relative to said fixed plate for controlling an outflow of a metallurgical vessel by the relative position of said first and second orifices; said slide plate being rotatable relative to said slideable tray; and a ratchet mechanism mounted on said slideable tray such that said slideable tray forms the fixed frame of said ratchet mechanism, said ratchet mechanism providing defined angular positions of said slide plate.

2. The sliding gate valve according to claim 1, further comprising a rotatable slide plate support mounted on said slideable tray and supporting said slide plate.

3. The sliding gate valve according to claim 2, wherein said ratchet mechanism comprises a ratchet wheel, which is fixed to said rotatable slide plate support, a pusher, which is mounted moveable on said slideable tray, and a pawl, which is pivotably mounted to said pusher, so as to transform linear action of said pusher into rotation of said slide plate.

4. The linear sliding gate valve according to claim 1, further comprising a coupling for a flow control actuator for positioning said slideable tray and a coupling fixed to said slideable tray for coupling a removable linear actuator to said ratchet mechanism. ,

5. The sliding gate valve according to claim 1, wherein a tightening contact pressure is provided between said slide plate and said fixed plate during operation and said sliding gate valve further comprises a pressure reduction device for controlled reduction of said contact pressure.

6. The sliding gate valve according to claim 5, further comprising a housing and a hinge to swing open said housing and wherein said pressure reduction device comprises a catch for limiting the opening of said housing.

7. The sliding gate valve according to claim 1, wherein said ratchet mechanism comprises a blocking mechanism for blocking rotation of said rotatable slide plate support.

8. The sliding gate valve according to claim 1, wherein said slide plate comprises a rotationally symmetrical, disc-shaped, refractory, said first orifice being rotationally symmetrical, circular, and provided centrically in said refractory.

9. The sliding gate valve according to claim 2, further comprising a clamping ring for fastening said slide plate, said clamping ring being blocked in rotation on said rotatable slide plate support and comprising a plurality of resilient fastening members for resiliently fastening said slide plate to said clamping ring.

10. The sliding gate valve according to claim 9, wherein said resilient fastening members are disposed in rotational symmetry on the inside of said clamping ring and their number is greater than 4 and odd.

11. The sliding gate valve according to claim 9, further comprising adjustable pre-tension means for applying a predetermined prestress to said resilient fastening members.

12. The sliding gate valve according to claim 9, wherein said clamping ring comprises at least three rigid links with corresponding articulations.

13. The sliding gate valve according to claim 9, wherein said slide plate comprises a rotationally symmetrical disc-shaped refractory, said first orifice being circular and provided centrically in said refractory, the ratio of the outer diameter of said refractory to the diameter of said first orifice is greater than or equal to 4.

14. The sliding gate valve according to claim 13, wherein said slide plate comprises an outer steel band, which rims said refractory by means of a shrinkage fit, said steel band and said clamping ring comprising cooperating blocking means for blocking said slide plate in rotation.

15. The sliding gate valve according to claim 1, wherein said slide plate and said fixed plate have identical dimensions.

16. A linear sliding gate valve for a metallurgical vessel, comprising:

a slide plate having a first orifice;

a fixed plate having a second orifice;

a slideable tray comprising a rotatable slide plate support for supporting said slide plate such that said slide plate is rotatable relative to said slideable tray, said slideable tray being arranged to slide said slide plate relative to said fixed plate for controlling an outflow of a metallurgical vessel by the relative position of said first and second orifices; and a ratchet mechanism for rotating said slide plate relative to said slideable tray and providing defined angular positions of said slide plate; and a clamping ring mounted on said rotatable slide plate support for fastening said slide plate, said clamping ring comprising a plurality of resilient fastening members for resiliently fastening said slide plate to said clamping ring.

17. The sliding gate valve according to claim 16, wherein said slide plate comprises a rotationally symmetrical, disc-shaped, refractory, said first orifice being rotationally symmetrical, circular, and provided centrically in said refractory.

18. The sliding gate valve according to claim 16, wherein said slide plate comprises a disc-shaped refractory, said first orifice being circular and provided centrically in said refractory, and wherein the ratio of the outer diameter of said refractory to the diameter of said first orifice is greater than or equal to 4.

19. The sliding gate valve according to claim 16, wherein said resilient fastening members are disposed in rotational symmetry.

20. The sliding gate valve according to claim 16, wherein said resilient fastening members are disposed on the inside of said clamping ring and the number of resilient fastening members is greater than 4.

21. The sliding gate valve according to claim 16, further comprising adjustable pre-tension means for applying a predetennined prestress to said resilient fastening members.

22. The sliding gate valve according to claim 16, wherein said clamping ring comprises at least three rigid links interconnected by corresponding articulations.

23. The sliding gate valve according to claim 17, wherein said slide plate comprises an outer steel band, which rims said refractory by means of a shrinkage fit, said steel band and said clamping ring comprising cooperating blocking means for blocking said slide plate in rotation.

24. A linear sliding gate valve for a metallurgical vessel, comprising:

a slide plate having a first orifice;

a fixed plate having a second orifice;

a slideable tray comprising a rotatable slide plate support for supporting said slide plate such that said slide plate is rotatable relative to said slideable tray, said slideable tray being arranged to slide said slide plate relative to said fixed plate for controlling an outflow of a metallurgical vessel by the relative position of said first and second orifices; and a mechanism for rotating the slide plate relative to said slideable tray; and a clamping ring mounted on said rotatable slide plate support for fastening said slide plate, said clamping ring comprising a plurality of resilient fastening members for resiliently fastening said slide plate to said clamping ring.

25. The sliding gate valve according to claim 24, wherein said slide plate comprises a disc-shaped refractory, said first orifice being circular and provided centrically in said refractory, and wherein the ratio of the outer diameter of said refractory to the diameter of said first orifice is greater than or equal to 4.

26. The sliding gate valve according to claim 24, wherein said resilient fastening members are disposed in rotational symmetry on the inside of said clamping ring and the number of resilient fastening members is greater than 4.

27. The sliding gate valve according to claim 24, further comprising adjustable pre-tension means for applying a predetermined prestress to said resilient fastening members.

28. The sliding gate valve according to claim 24, wherein said clamping ring comprises at least three rigid links interconnected by corresponding articulations.

29. The sliding gate valve according to claim 25, wherein said slide plate comprises an outer steel band, which rims said refractory by means of a shrinkage fit, said steel band and said clamping ring comprising cooperating blocking means for blocking said slide plate in rotation.

* * * * *